United States Patent [19]

Higgins

[11] 4,053,956

[45] Oct. 18, 1977

[54] SPRING ASSEMBLY

[75] Inventor: Larry Higgins, Carthage, Mo.

[73] Assignee: Leggett & Platt, Incorporated, Carthage, Mo.

[21] Appl. No.: 699,481

[22] Filed: June 24, 1976

[51] Int. Cl.[2] ..... A47C 23/02; A47C 23/04

[52] U.S. Cl. ..... 5/255; 5/260; 5/267

[58] Field of Search ..... 5/263, 267, 260

[56] References Cited

U.S. PATENT DOCUMENTS

| | | | |
|---|---|---|---|
| 1,947,931 | 2/1934 | Falls | 5/260 |
| 2,184,572 | 12/1939 | Wainess | 5/260 |
| 2,542,354 | 2/1951 | Platt | 5/267 |
| 3,688,320 | 9/1972 | Hartley et al. | 5/267 |
| 3,911,511 | 10/1975 | Higgins et al. | 5/255 |

*Primary Examiner*—Paul R. Gilliam
*Assistant Examiner*—Alex Grusz
*Attorney, Agent, or Firm*—Wood, Herron & Evans

[57] ABSTRACT

An improved spring assembly in which the springs are connected together by a novel thermoplastic connector strip structure. The connector strip structure is used to interconnect the spring rows one with another, and also functions as a border strip, to establish a connector grid for the springs in each of the top and bottom planes of the spring assembly.

9 Claims, 5 Drawing Figures

SPRING ASSEMBLY

This invention relates to spring assemblies. More particularly, this invention relates to an improved spring assembly in which the spring units are interconnected together by a novel connector strip structure.

Spring assemblies, as are commonly known to the art, are fabricated of a plurality of individual springs positioned in matrix-like fashion. These springs are held in spatial relation relative one to the other, i.e., the rows and columns of springs in the matrix are held in spatial relation relative one to the other, by some type of fastener device adapted to interconnect those springs.

It is common practice in the spring assembly art to connect adjacent individual springs one with the other in both the top plane and the bottom plane of the spring assembly. Two basic types of interconnections are provided, one surrounding the spring assembly in border-like fashion in both the top and bottom planes, and the other interconnecting adjacent rows of the springs one with the other in both the top and bottom planes. The border connection is generally provided by a single, heavy gauge wire disposed in border fashion around the periphery of the spring matrix in each of the top and bottom planes of that matrix. The border wire is held to those springs that define the border of the spring assembly's matrix by any type of wire fastening means known to the art, e.g., metal clips, wire spiraled around the border wire and the springs, or the like. Interior adjacent spring rows of the spring assembly are connected one with the other and with the border spring rows, by similar type connector devices. It is also known to the prior art to provide a wire grid in both the top and bottom planes of the spring assembly. With such grinds, the springs are attached thereto, instead of directly to one another, by hooks formed in the grid wires, or separate metal clips, or the like. The wire grids, of course, include border wires. Typical prior art connector means are shown in U.S. Pat. Nos. 3,653,082 and 3,725,965.

Although the above mentioned type of connectors have been found quite useful in commercial practice, same require substantial manual labor in fabrication of the spring assembly or, alternatively, costly capital equipment if the fabrication is mechanized.

Accordingly, it has been the primary objectve of this invention to provide an inexpensive plastic connector strip adapted to interconnect springs one with another in a spring assembly's matrix in both the top and bottom planes of the spring assembly.

Another objective of this invention has been to provide a unique thermoplastic connector strip structure adapted to connect adjacent rows of springs one with another, as well as to form the peripheral border, for a spring assembly.

In accord with these objectives, the improved spring assembly of this invention has the springs of the matrix connected together with a novel thermoplastic connector strip structure. The connector strip structure is used to interconnect the spring rows one with another, and also functions as a border strip, to establish a connector grid for the springs in each of the top and bottom planes of the spring assembly. The thermoplastic connector strip, on one edge thereof if same is for use as a border strip and on both edges thereof if same is for use as a row connector strip, is provided with a pair of jaws. The jaws are structured to receive a loop of the spring wire of each spring in at least nominal mechanical gripping relation therewith, the jaws thereafter being heat welded together to restrain that loop therein, thereby locking the spring to the connector strip.

Other objectives and advantages of this invention will be more apparent from the following detailed description taken in conjunction with the drawings in which.

Figure 1:
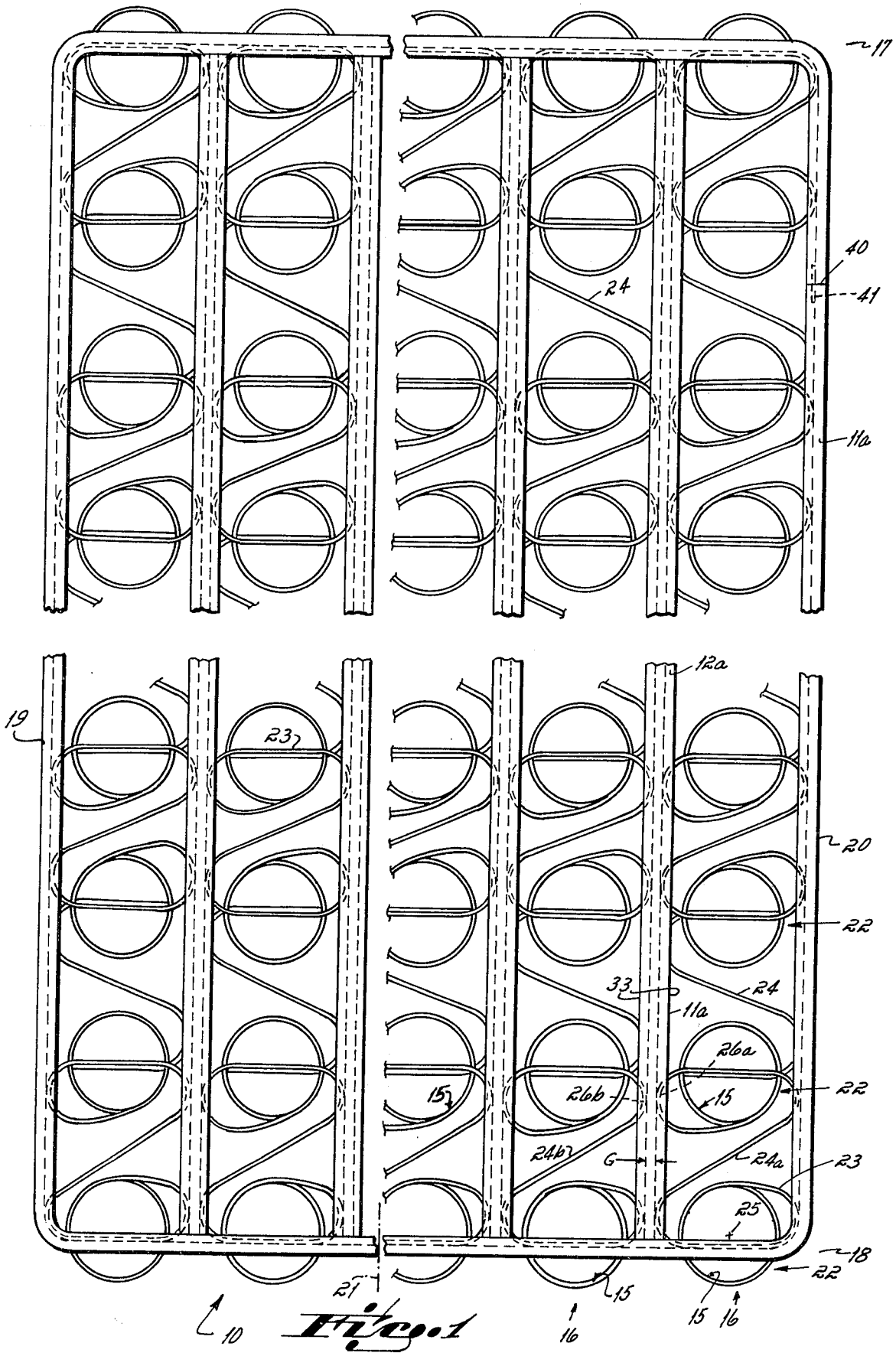
FIG. 1 is a top view illustrating an improved spring assembly in accord with the principles of this invention.
Figure 2:
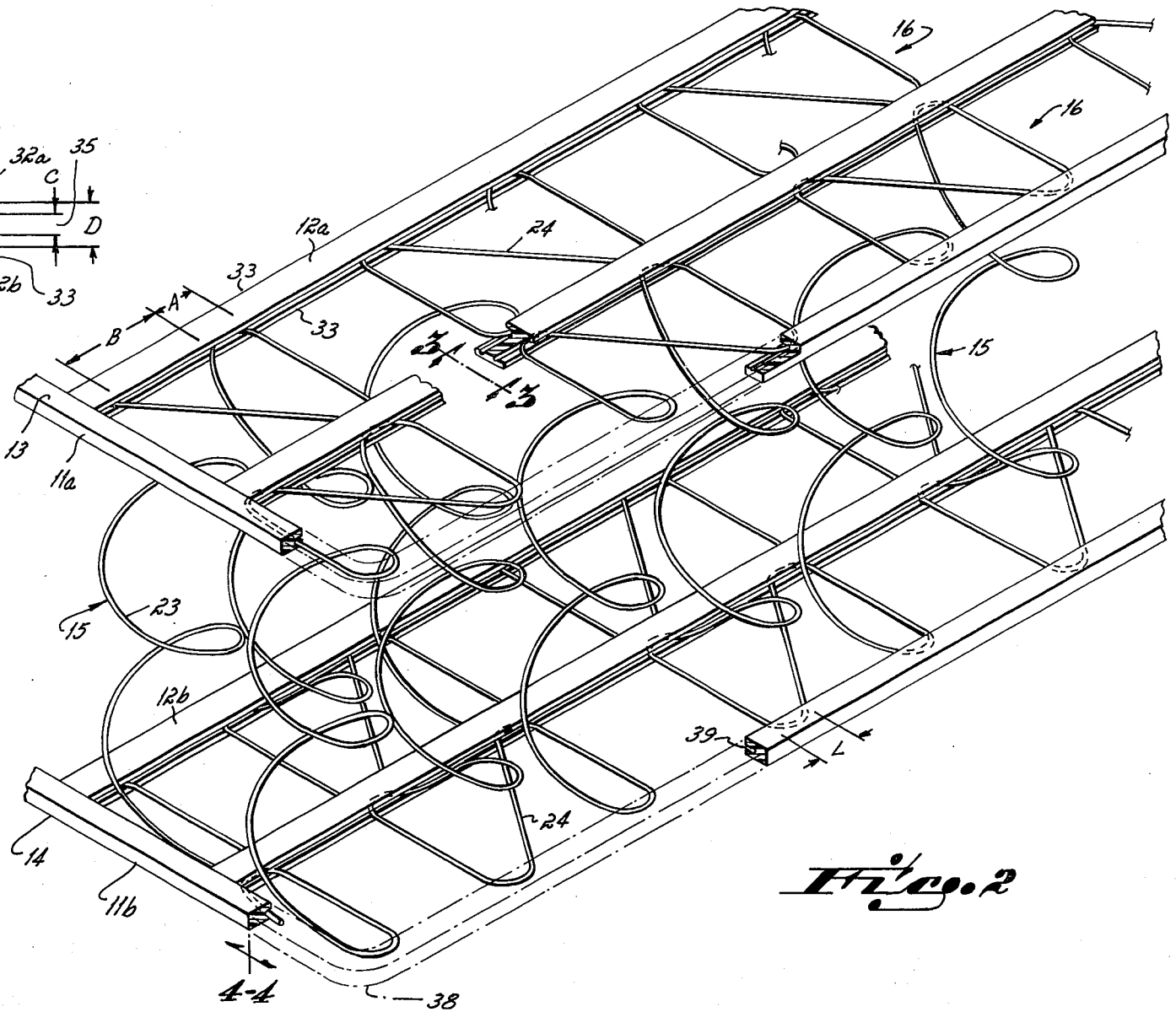
FIG. 2 is a perspective view of a corner of the improved spring assembly illustrated in FIG. 1.

Referring now to the drawings and particularly to FIGS. 1 and 2, there is shown an improved spring assembly 10 utilizing thermoplastic connector strips 11, 12 all in accord with the invention of this application. The upper plane or surface 13 of the spring assembly 10 has a generally rectangular periphery which is enclosed by border connector strip 11*a*, and includes connector strips 12*a*, all to form a top grid 11*a*, 12*a*. Similarly, the lower plane or surface 14 of the spring assembly 10 has a rectangular periphery which also is enclosed by border connector strip 11*b*, and which includes row connector strips 12*b*, all to form a lower grid 11*b*, 12*b*. The individual spring coils 15 are maintained in matrix fashion, i.e. in spring assembly 10, by the top 11*a*, 12*a* and bottom 11*b*, 12*b* grids of the thremoplastic connector strips 11, 12.

The improved spring assembly 10 includes a plurality of longitudinal rows 16 of spring coils 15 each of which extend longitudinally of the spring assembly between head or top edge 17 and foot or bottom edge 28 thereof. The longitudinal rows 16 of coils 15, which are parallel to side edges 19, 20 of the assembly 10, are also positioned closely adjacent to one another but are spaced slightly from one another by a gap G, i.e., the longitudinal rows 16 do not overlap in that direction normal to the longitudinal axis 21 of the spring assembly 10. The longitudinal rows 16 of coils 15 are aligned within the spring assembly 10 so as to establish cross rows 22 of coils oriented transverse to the longitudinal rows 16, the coils within each cross row 22 being connected with adjacent coils in that row by row connector strips 12*a*, 12*b*.

Each longitudinal row 16 of coils is formed from a single, continuous length of wire 23, thereby obviating the need for connector devices of any kind between adjacent coils in those lontigudinal rows. The wire 23 is wound to form a plurality of spaced individual coils that are interconnected one with another by substantially Z-shaped wire segments 24 disposed, sequentially, first in the upper plane 13 and then in the lower plane 14 of the spring assembly 10. Each Z-shaped segment 24 is paired with a coil 15 so that, in effect, that segment is a functional part of the coil 15. Each row 16 of coil 15 is configured identical to each adjacent row, and each coil within each row is identical to every other coil within that row. Note also that the Z-shaped segments 24 which interconnect the coils 15 within the longitudinal rows are themselves aligned both in longitudinal rows and in cross rows in the upper 13 and lower 14 planes of the spring assembly 10.

More particularly, and with reference to the coils 15 in each longitudinal row 16, each coil has the same number of turns as every other coil. The vertical axes 25 of all of the coils of a single row (whether a longitudinal 16 or a cross row 22) are located in the same vertical plane 16 or 22 respectively. The axes 25 of adjacent coils 15 are equidistant one from the other in both the longitudinal 16 and cross 22 rows, the axes being generally perpendicular to the upper 13 and lower 14 planes of the spring assembly 10. While each of the coils 15 is illustrated as having approximately two full turns or convolutions, this number is not critical. A greater or lesser number of convolutions may be used, depending upon the tensile strength of the wire 23 and the manner in which the coils 15 are formed, so as to provide a spring force appropriate to the particular application. The spring 15 structure of this type spring assembly 10 is more particularly described in U.S. Pat. No. 3,911,511.

As will be appreciated from the following description, the coil 15 interconnection technique utilized in the spring assembly 10 may be used with other types of springs or spring forms as well. For example, any one of a variety of spring 15 shapes may be employed such as hourglass or potbellied, but the cylindrical shape illustrated is preferred. Further, and although the springs 15 in each longitudinal row 16 are all connected together by virtue of being fabricated from a single wire length, it will be understood that spring forms may be used in which the springs within each longitudinal row are separately formed one from the other as well.

In order to connect the adjacent longitudinal rows 16 of coils 15, the Z-shaped segments 24 which interconnect adjacent coils within each longitudinal row are positioned so that they do not overlap, but are closely adjacent to, the Z-shaped segments of the adjacent longitudinal rows of coils. The corner portions 26 of the closely adjacent but non-overlaped Z-shaped segments 24 (i.e., of the coils 15) are tied together by the thermoplastic connector strips 11, 12, thereby tying together the coils. A first set of row connector strips **11*a* is disposed within the upper plane 13 of the spring assembly 10 so as to join together closely adjacent corner portions 26*a*, 26*b* of the coils' upper Z-shaped segment pairs 24*a*, 24*b* in adjacent longitudinal rows 16. Similarly, a second set of row connector strips 11*b* is disposed within the lower plane 14 of the spring assembly 10, same serving to join together closely adjacent corner portions 26*a*, 26*b* of the coils' lower Z-shaped interconnection segment pairs 24*a*, 24*b* in adjacent longitudinal rows 16. Note particularly that one less row connector strip 11*a* and 11*b* is used in each of the spring assembly's planes 13, 14, respectively, than there are longitudinal rows 16 in that spring assembly 10. As is evident in the top view of FIG. 1, the length of each row connector strip 11 is substantially equal to the length of the rows 16, and the row connector strips 11 extend parallel to the longitudinal rows. In addition to the row connector strips 11, a border connector strip 12*a*, 12*b* extends around the periphery of the spring assembly in each of the upper 13 and lower 14 planes respectively of the assembly. The border connector strips 12 interconnect coils 15 within each longitudinal row 16 that extends along the side edges 19 and 20 of the spring assembly 10, and also interconnect coils within rows 22 adjacent the head 17 and foot 18 edges of the assembly 10. Thus, the row connector strips 11*a* and border connector strip 12*a* in the assembly's top plane 13 forms a top grid 11*a*, 12*a*, and the row connector strips 11*b*, 12*b* and border connector strips in the assembly's bottom plane 14 forms a bottom grid 11*b*, 12*b*, by which the spring coils 15 are held in matrix configuration one with the other. When interconnected, adjacent coils 15 are free to move vertically in independent fashion relative one to another to a limited degree, but are locked aginst relative longitudinal or lateral movement relative to longitudinal axis 21 of the spring assembly 10. In other words, the connector strips 11, 12 permit only limited relative pivotal movement of Z-shaped segments 24 between the adjacent interconnected coils 15**.

Figure 3:
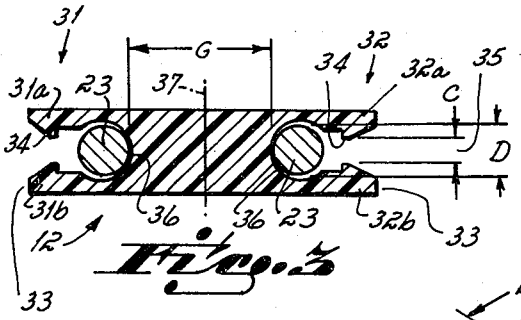
FIG. 3 is a cross-sectional view taken along lines 3—3 of FIG. 2.

The row connector strip 11 used to interconnect adjacent longitudinal rows 16 of springs 15 is illustrated in cross section in FIG. 3. As shown in that figure, same is a generally planar strip having opposed pairs 31, 32 of jaws that extend along opposed side edges 33 thereof from one end 17, 18 of the strip to the other. In other words, the row connector strip 11 is identical in configuration from one end 17 to the other 18 as illustrated in cross section in FIG. 3, thereby permitting same to be extruded of thermoplastic during manufacture. The jaws 31, 32 on each side edge 33 include an upper jaw **31*a*, 32*a* and a lower jaw 31*b*, 32*b*, same being configured with inwardly extending teeth 34 thereon. The row connector strip 11, as initially manufactured (as shown in FIG. 3), provides a clearance C between the jaws' teeth 34 slightly less than the diameter D of the spring wire 23 same is adapted to restrain. Each pair of jaws 31, 32 defines a mount 34 which provides a seat 36 for the spring wire 23. In assembly with the adjacent longitudinal rows 16 of springs 15, the corner portions 26*a*, 26*b* of adjacent Z-shaped segments 24*a*, 24*b* are preliminarily received between jaws 31, 32 of opposed side edges 33 of the row connector strip 11. The teeth 34 on the jaws 31, 32 serve to provide a temporary and nominal mechanical connection between the Z-shaped segment corners 26*a*, 26*b* and the row connector strip 11. In other words, and because the row connector strip 11 is fabricated of a thermoplastic, a degree of resilience is inherent in the jaws 31, 32 which permits the jaws to flex open as the corner 26 of a Z-shaped segment 24 is thrust into the row connector strip's mouth 35, the jaws thereafter flexing back toward the FIG. 3 attitude to trap that corner 26 therein. Subsequent to positioning of the Z-shaped segments' corners 26 in the opposed mouth 35 of the row connector strip 16 along the length thereof, that length A of the jaws defined between each angled corner 26 of the Z-shaped segment 24 is heat welded or fused together, thereby providing a mechanically effective and binding joint between the row connector strip 11 and the Z-shaped segments' corners 26. That length B of the row connector strip 11 between the corners 26 of the Z-shaped segments 24 is not heat sealed or heat welded together since same is not necessary to restrain the Z-shaped segment's corner 26 in operative combination with the row connector strip 11. As shown in FIG. 2, the jaws 31, 32 of the row connector strips 11 are not fused or heat welded at corners 26 of Z-shaped segments 24 in the spring assembly's upper plane 13, but are heat welded together (as above described) at corners of Z-shaped segments 24 in the spring assembly's bottom plane 14. It will be understood, of course, that the jaws 31, 32 of the row connector strips 11 are fused together as above described in both upper 13 and bottom 14** planes in actual practice.

Figure 4:
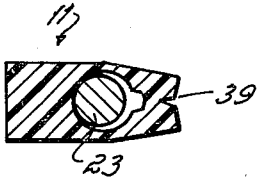
FIG. 4 is a cross-sectional view taken along line 4—4 of FIG. 2.
Figure 5:
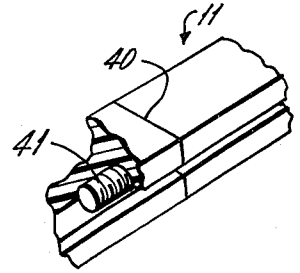
FIG. 5 is perspective view of a joint for the border connector strip.

The connector strip 12 illustrated in FIG. 4 is used as a border connector strip along the outer periphery of the spring assembly 10. As shown in FIG. 4, the border connector strip 12 is, in effect, one-half of a row connector strip 11, the row connector strip being split along the longitudinal center plane 37 thereof into two border strips. The border connector strip 12 is used in the same manner as the row connector strips, same simply being curved around the corners (as at 38) at the corners in both the upper 13 and lower 14 planes of the spring assembly 10; such curvature is easily achieved in light of the fact that the thermoplastic material from which the strip 12 is fabricated is quite flexible. In order words, the border connector strip 12 is simply a single extended length strip configured to conform to the periphery of the spring assembly 10, that strip being butted at joint 40. The joint 40, as shown in FIG. 5, includes a threaded shaft 41 slightly oversized relative to seat 36, that shaft 41 being press fit into the seal to mechanically connect the ends of the strip 12. The joint 40 may be heat welded to insure mechanical stability of the joint. Note the joint 40 is positioned between adjacent coils 15. As with the row connector strips, the jaws 39 of the border connector strips 12 are not continuously heat welded along the jaw edge thereof. The border connector strips 12 are simple tack heat welded within that length L confined by each Z-shaped segment's corner 26 so as to maintain the springs 15 on the periphery of the spring assembly 10 in fixed mechanical relation with the border connector strips. FIG. 4 illustrates jaws 39 of the border strip 12 after same have been heat welded together to trap a Z-shaped segment's corner 26 therebetween.

As shown in the figures, row connector strips 11 are butted at opposed ends to the jaw 39 edge of border connector strip 12. These butt joints are then heat welded or fused together so as to provide an integral connector grid 11, 12 for the springs 15 in both the top plane 13 and bottom plane 14 of the spring assembly 10. The heat welding of the row strips 11 to the border strips 12 at the butted joints, and of those strips' jaws 31, 32, 39 to one another at the corners 26 of the Z-shaped segments 24, may be accomplished by any known type of thermoplastic heat welding machinery suitable for that purpose.

As previously mentioned, it is necessary that the connector strips 11, 12 used in the improved spring assembly of this invention be fabricated of a thermoplastic material (as opposed to a thermosetting material). This for the reason that the connector strips 11, 12 must be heat welded or fused together at the butted joints, as well as because the strips' jaws 31, 32, 39 must be heat welded together to positively interconnect the strips with the Z-shaped segments 24. The preferred thermoplastic material at this time for the connector strips is polypropylene. When the preferred polypropylene is used, the machinery's jaws by which the connector strips 11, 12 are butt welded one to the other, or by which the upper and lower jaws 31, 32, 39 of the strips are heat welded one to the other, may be operated within a temperature range of between approximately 250° F. and 350° F.

A particular advantage of the connector strip 11, 12 structure of this invention is that same can be extruded in a continuous length, same thereafter being cut to the desired length from the continuous extruded piece, so as to simplify manufacture and reduce costs.

Having described in detail the preferred embodiment of my invention, what I desire to claim and protect by Letters Patent is:

1. An improved spring assembly comprising a plurality of springs disposed in matrix-like fashion in a plurality of rows, at least one linear border connector strip in at least one of the upper and lower planes of said spring assembly, said border connector strip connecting the peripheral springs in said spring assembly one with the other, said connector strip being fabricated of a thermoplastic material, said connector strip defining jaw structure that receives a segment of each peripheral spring in gripping relation therewith, and said border strip jaw structure being heat welded around each peripheral spring segment for locking each adjacent peripheral spring to said border connector strip, and a linear row connector strip between at least one pair of adjacent rows of springs in that one of said planes in which said border connector strip is disposed, each of said row connector strips connecting the two adjacent rows of springs in each pair one with the other, said row connector strip also being fabricated of a thermoplastic material, said row connector strip defining jaw structure on both side edges of said strip from one end thereof to the other, said row jaw structure receiving a segment of each spring in the adjacent rows of each pair in gripping relation therewith, and said row jaw structure also being heat welded around each row spring segment for locking each adjacent row spring to said row connector strip, said border connector strips and said row connector strips thereby establishing a thermoplastic strip grid by which said plurality of springs are tied together one with another in that one of the upper and lower planes of said spring assembly.

2. An improved spring assembly as set forth in claim 1, each of said row connector strips being of a length substantially equal to the length of the row to which it is connected.

3. An improved spring assembly as set forth in claim 2, at least one of said row connector strips being connected with said border connector strip, said strips being connected by heat welding one to the other.

4. An improved spring assembly as set forth in claim 1, the number of row connector strips being equal to a number that is one less than the total number of rows of springs.

5. An improved spring assembly as set forth in claim 1, at least one of said rows of springs comprised of a continuous length of wire, said continuous length of wire including substantially Z-shaped segments of wire interconnecting adjacent coils in said row, said substantially Z-shaped segments being disposed alternatively in first and second planes generally perpendicular to the axis of said coils at the ends thereof, said Z-shaped segments in one spring row being connected with said Z-shaped segments in an adjacent row by said row connector strips, and said Z-shaped segments of the peripheral springs being connected one with the other by said border connector strip.

6. An improved spring assembly as set forth in claim 5, said rows being spaced one from another with no overlap of said Z-shaped segments.

7. An improved spring assembly as set forth in claim 1, said border strip being comprised of a single continuous length member, the opposite ends of said member being joined one with another to form a single continuous loop about the periphery of said assembly.

8. An improved spring assembly as set forth in claim 1 comprising a grid of row connector and border connector strips in the upper plane of said assembly, and a grid of said border and row connector strips in the bottom plane of said assembly, said top and bottom grids being substantially identical one to the other.

9. An improved spring assembly as set forth in claim 1, said connector strips being fabricated of a polypropylene.

* * * * *